US006042397A

United States Patent [19]

Kusuhara

[11] Patent Number: 6,042,397

[45] Date of Patent: Mar. 28, 2000

[54] BOARD-MOUNTED CONNECTOR

[75] Inventor: Toshitaka Kusuhara, Kanagawa, Japan

[73] Assignee: The Whitaker Corporation, Wilmington, Del.

[21] Appl. No.: 09/126,049

[22] Filed: Jul. 30, 1998

[30] Foreign Application Priority Data

Jul. 30, 1997 [JP] Japan ..... 9-219140

[51] Int. Cl.[7] ..... H01R 4/66

[52] U.S. Cl. ..... 439/101; 439/95; 439/610

[58] Field of Search ..... 439/607–610, 439/95, 101, 108, 77–81

[56] References Cited

U.S. PATENT DOCUMENTS 5,161,999 11/1992 Broschard, III et al. ..... 439/567
5,286,212 2/1994 Broeksteeg ..... 439/108
5,399,105 3/1995 Kaufman et al. ..... 439/609
5,470,259 11/1995 Kaufman et al. ..... 439/607
5,775,923 7/1998 Tomioka ..... 439/79
5,795,190 8/1998 Ono ..... 439/607

*Primary Examiner*—Lincoln Donovan

[57] ABSTRACT

An extension (40) of a ground plate (6) is bent in the area where it overlaps with sections (22*a*) of termination sections (22) of electrical contacts (20) bent in a crank-like configuration, thereby forming a space sufficient for the placement of an intermediary connector (80) between a mother board (50) and a board-mounted connector (1). Since openings (46) are located in the extension (40), it does not engage with the bent sections (22*a*) of the electrical contacts (20).

8 Claims, 5 Drawing Sheets

BOARD-MOUNTED CONNECTOR

FIELD OF THE INVENTION

This invention relates to board-mounted connectors, especially to board-mounted connectors intended for electrical connection of PC memory cards.

BACKGROUND OF THE INVENTION

Board-mounted connectors intended for electrical connection of PC memory cards are usually electrically connected to a mother board by means of intermediary boards. For example, a board-mounted connector 100 described in Japanese Patent Publication No. 9-22762 shown in FIG. 5, is known in the art. In the board-mounted connector 100, electrical contacts 104,104' and ground contacts 106,108, 110 retained in housing 102 are electrically connected to junction board 112. Junction board 112 is electrically connected to electrical contacts 122 of another intermediary electrical connector 120, with the connector 100 and the intermediary connector 120 being electrically connected to the mother board (not shown). In order to firmly join the connector 100 to the mother board, lugs 114 are provided on the bottom surface of the connector 100 that correspond to the intermediary connector 120.

Since in the above example the connector must be mounted on the mother board by means of the intermediary connector 120, the first connector must have lugs 114 that have practically the same height as the intermediary connector 120. Therefore, one of the disadvantages of this connector is that the board-mounted connector 100 occupies considerable space on the mother board.

Considering the above disadvantage, a purpose of the present invention is to achieve a low mounting height of the connector including a mounting fixture even if such fixtures are needed.

Another purpose of the present invention is to reduce the height of the connector and to move it closer to a junction board.

SUMMARY OF THE INVENTION

The board-mounted connector according to the present invention has electrical signal contacts and ground contacts extending from a rear of the housing, and the ground contacts form a single ground plate which is bent in such a manner that it intersects with the signal contacts, the ground plate creates a gap between the connector and the board to which it is mounted, and the intersecting section of the ground plate has openings that accommodate signal contacts so that they are separated from each other.

The board-mounted connector according to the present invention has electrical signal contacts and ground contacts, a housing mounted on a mother board, and a junction board to which contacts extending from a back end of the housing are electrically connected to the mother board by means of an intermediary connector mounted on the mother board. The ground contacts are fabricated in the form of a single ground plate having a bent section intersecting with the signal contacts, which provides space for the accommodation of the intermediary connector and has openings to keep the signal contacts separated from each other.

It is desirable that the contacts extending from the housing are bent in the form of a crank offset from the board so that they can intersect with the ground plate.

BRIEF DESCRIPTION OF THE DRAWINGS

An embodiment of the present invention will now be described by way of example with reference to the accompanying drawings, in which:

FIG. 3B is a rear view looking from the bottom of FIG. 3A, and FIG. 3C is a cross-sectional view taken along line 3C—3C of FIG. 3A;

DETAILED DESCRIPTION OF THE INVENTION

Figure 1:
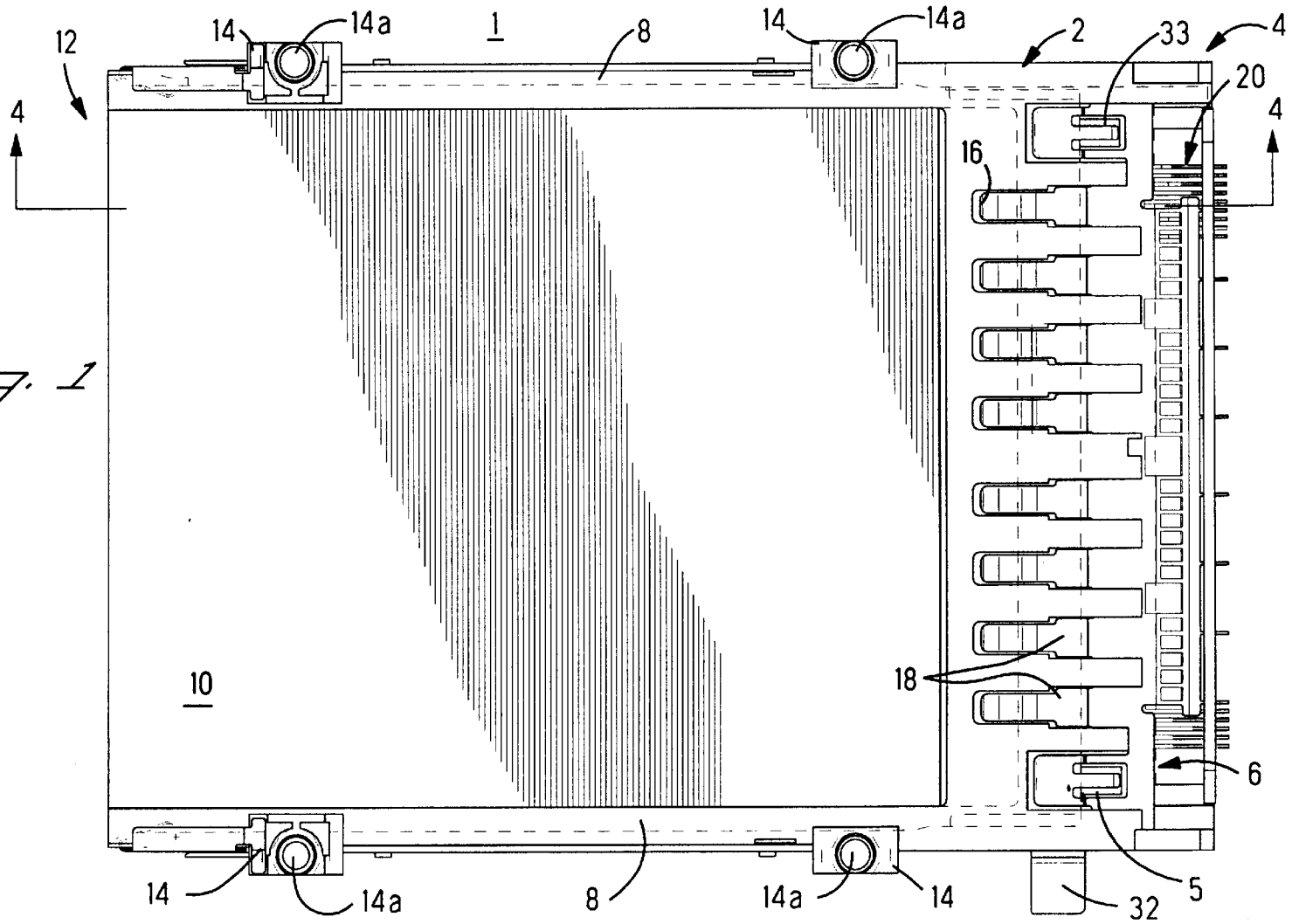
FIG. 1 is a top plan view of a board-mounted connector according the present invention.

FIG. 1 shows connector 1 comprising a housing 2 having on both sides channel-shaped guides. A frame plate 10 spanning a ground plate 6 and guides 8 is inserted from a back end 4 of the housing 2 and secured thereto. Connector 1 is intended for the reception of a PC or other type of a memory card 70 (see FIG. 4). The card 70 is inserted from the left side of FIG. 1, that is, from a front face 12 of the connector. Guides 8 of the housing 2 have four mounting fixtures 14 having mounting holes 14*a*. The connector 1 is secured on a mother board 50 (see FIGS. 2 and 4) by means of screws 7 (see FIG. 2) screwed in the mounting holes 14*a*.

Figure 3A:
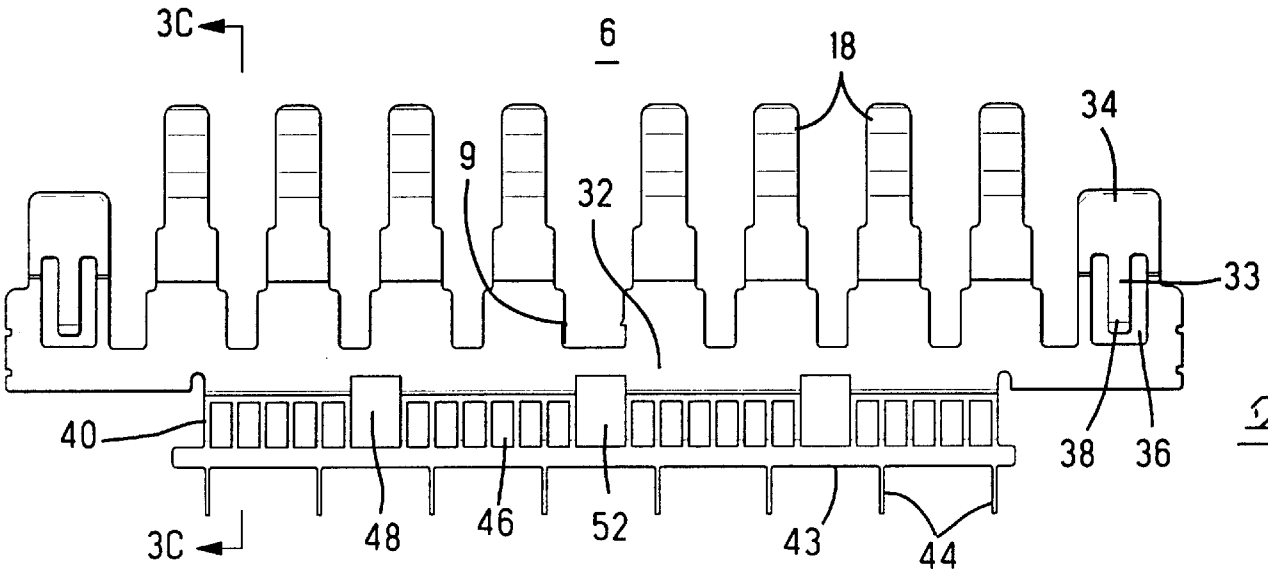
FIGS. 3A–3C show a ground plate with FIG. 3A being a plan view.
Figure 3B:
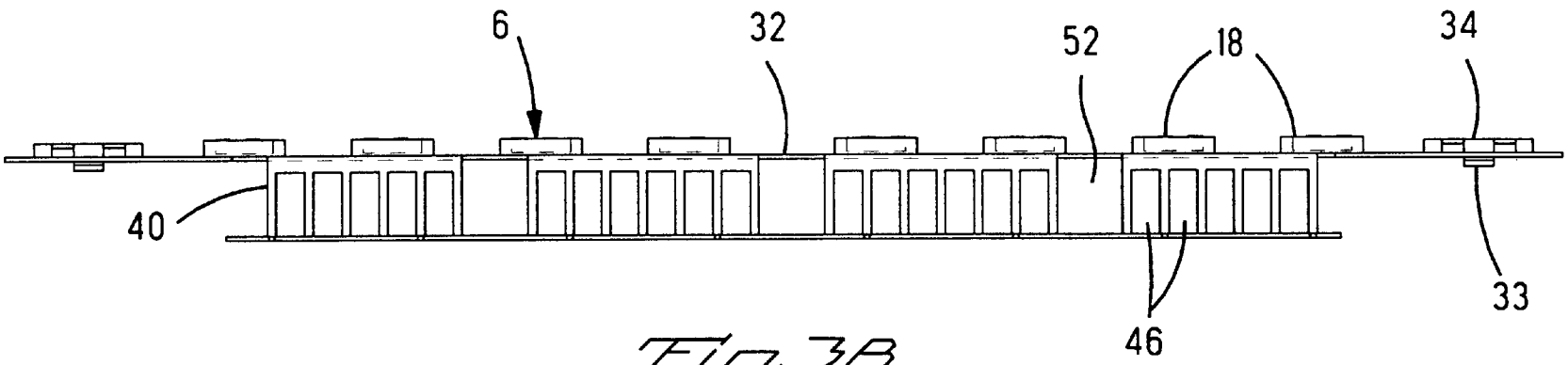
Figure 3C:
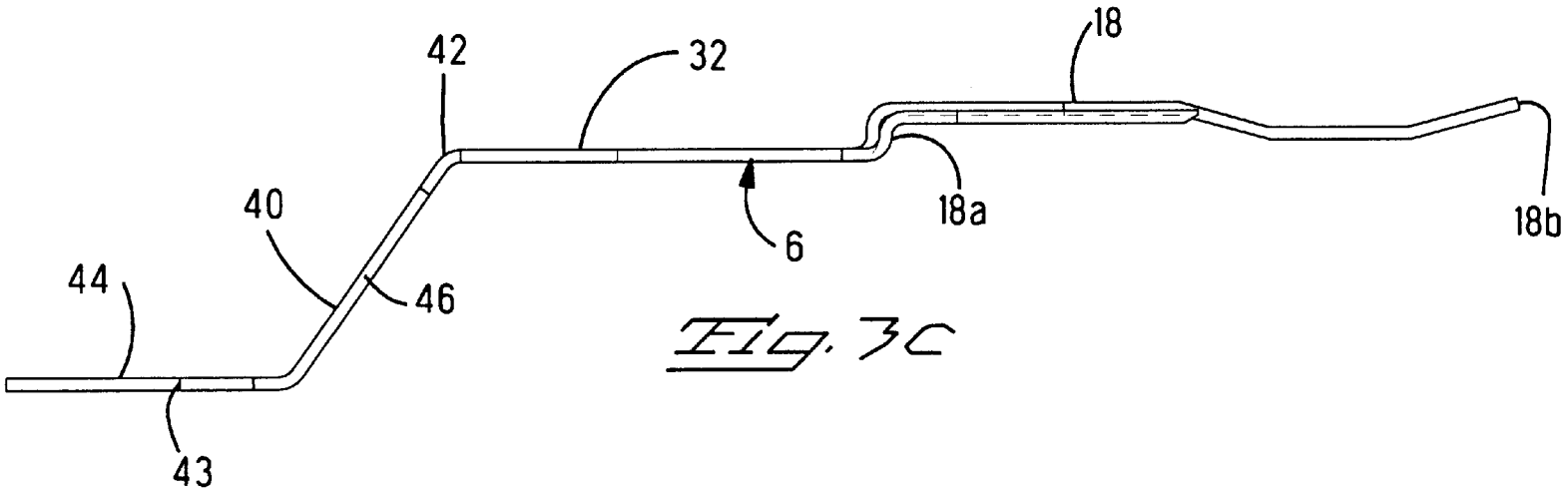
Figure 4:
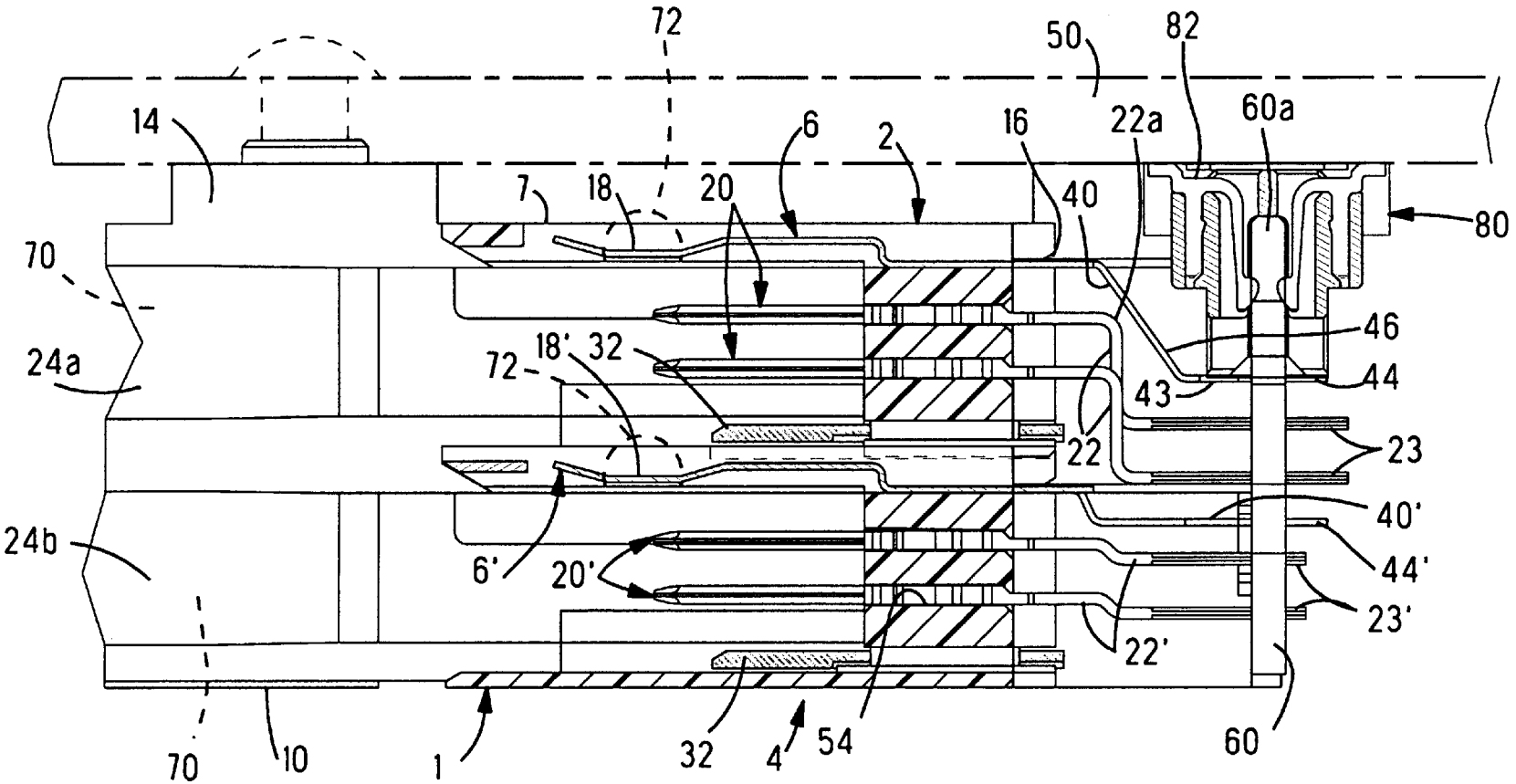
FIG. 4 is a part cross-sectional view of the board-mounted connector taken along line 4—4 in FIG. 1.
Figure 5:
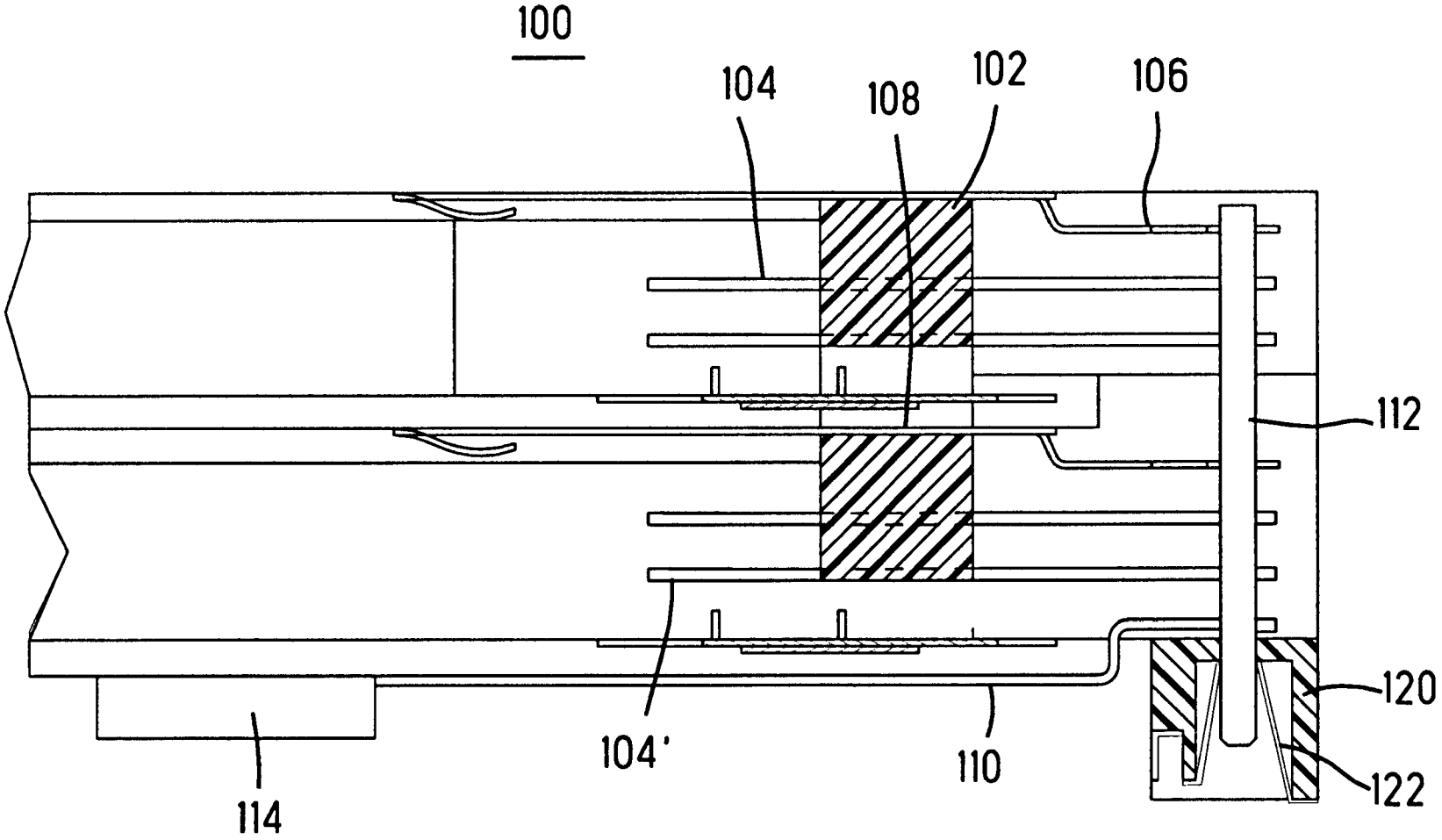
FIG. 5 Prior Art
FIG. 5 is a part cross-sectional view of a conventional board-mounted connector.

From FIGS. 1 and 4, it can be seen that electrical contacts 20 arranged in rows extend from a back end 4 of the housing 2. A number of grooves 16 extends toward the front end from the back end 4 of the housing 2 and are located at predetermined intervals. The ground plate 6 has tabs 18 inserted within the grooves. At both edges of the ground plate 6, spring-loaded tongues 33 are formed which are used to secure the ground plate on the housing 2 by engaging with housing shoulder 5. The ground plate 6 is illustrated in detail in FIGS. 3A–3C.

Figure 2:
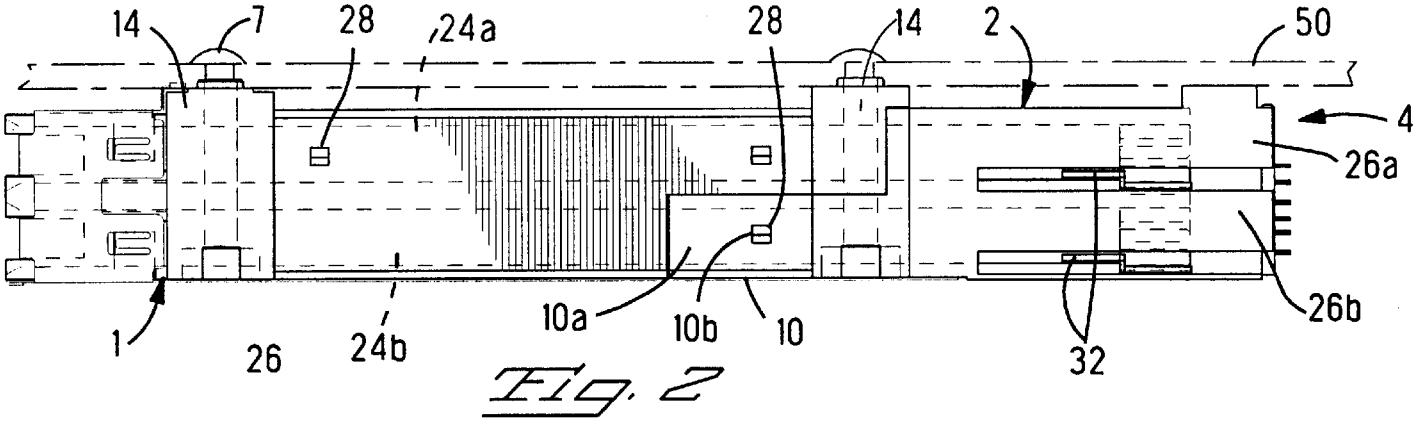
FIG. 2 is a side view of the board-mounted connector shown in FIG. 1.

In FIG. 2, the connector 1 is shown in a state when it is mounted under the mother board 50 by screws 7 screwed through the upper surface of the board 50. The housing 2 has card-receiving slots 24*a*, 24*b* for the insertion and receipt of two PC cards arranged one above the other. The frame plate 10 has mounting members 10*a* formed at both edges of the frame plate. Openings 10*b* provided in the mounting members 10*a* are engaged with lugs 28 formed on the side walls of the housing 2, thus securing the frame plate underneath of the housing 2. At the back end 4 of the housing 2, two side walls 26*a*, 26*b* are formed which correspond to the two card-receiving slots 24*a*, 24*b*. An ejection arm 32 intended for the ejection of PC cards from the card-receiving slots, can be seen between side walls 26*a*, 26*b* and under the side wall 26*b*. Since the operation of the ejection arm is known, detailed explanation thereof is omitted.

FIGS. 3A–3C show the ground plate 6. As can be seen from FIG. 3A, the ground plate 6 has a number of tabs 18 extending forward from base section 32 in a longitudinal direction. Latches 34 are provided on both sides of tabs 18, at the edges of the base section 32. Latches 34 have spring-loaded tongues 33 extending backward that are formed by U-shaped slots 36. The spring-loaded tongues 33 are bent in the direction of the reverse side of the page containing FIG. 3A and extend from a bottom surface of the latches 34. Free ends 38 of the spring-loaded tongues 33 are engaged with shoulders 5 of housing 2 (see FIG. 1), thus preventing ground plate 6 from removal. On the opposing sides of central tabs 18 are formed barbs 9 the purpose of which is to secure the ground plate in the housing 2.

An extension 40 formed at the back end of the base section 32 has termination members 44 extending in a backward direction from a back edge of the extension 40 at predetermined intervals therealong. In extension 40 are formed rectangular openings 46, and openings 48, 52 of a larger size than openings 46 are also provided.

From FIG. 3B, it can be seen that the extension 40 is bent downward. The configuration of ground plate 6 is clearly shown in FIG. 3C. The tab 18 extends to the front via a step section 18*a*, after which it is bent down and then up to the tip 18*b*. Extension 40 is configured as a slanted intermediary piece extending down from the back end 42 of base section 32 with a horizontal end section 43 from which termination members 44 extend.

FIG. 4 represents a partial cross-sectional view along line 4—4 in FIG. 1. In the back end 4 of the housing 2, signal contacts 20,20' corresponding to card-receiving slots 24*a*, 24*b* are pressed into and retained in their respective contact-receiving cavities 54. Termination sections 22 of contacts 20 extending from the back end of the housing 2 are shaped like cranks with downward bends. Because of this, a sufficient space is formed between the mother board 50 and front sections 23 of termination sections 22. The front sections 23 are inserted in through holes (not shown) of an intermediary or junction board 60 and connected thereto by soldering. Termination sections 22' of contacts 20' are also deflected down and connected to the junction board 60 by soldering.

The ground plates 6, 6' are inserted in grooves 16 from the back end of the housing 2. Tabs 18, 18' of the ground plates 6, 6' are positioned in the upper parts of the card-receiving slots 24*a*, 24*b*, respectively. PC cards 70 are inserted in card-receiving slots 24*a*, 24*b* as shown by dotted lines. At this time, tabs 18, 18' engage with multiple grounding lugs 72 located on the upper surfaces of PC cards 70, thus connecting them to ground. Termination members 44, 44' of extensions 40,40' of the ground plates 6,6' are inserted in through holes of junction board 60 and soldered thereto. Since the sections 22*a* of the contacts 20 bent at a right angle overlap with the slanted extension 40 of the ground plate 6, the right-angle sections 22*a* are aligned with respective openings 46 and can extend through openings 46 of extension 40 without engaging therewith. Since a rather large space is formed between the extension 40 and mother board 50, an intermediary or junction connector 80 can be placed therebetween. As shown in FIG. 4, junction connector 80 can be made of rather small dimensions only slightly extending above an upper surface 7 of housing 2. Since the extension 40' of the ground plate 6' in this embodiment does not have to be slanted very much, it does not intersect with the termination sections 22' of contacts 20'.

A front edge 60*a* of junction board 60 is inserted in the junction connector 80 and respective conductive pads thereon form electrical connections with electrical contacts 82. Therefore, the distance from the back end 4 of the housing to the junction board 60 can be made short and the junction connector 80 can be placed closer to connector 1, thus making it possible to reduce the area occupied by the connecting elements on the mother board 50 and the overall area contributing to general reduction of the connector size. Therefore, both the actual height of connector 1 and the area occupied by it on the mother board 50 is reduced.

Above, a detailed explanation concerning a board-mounted connector according to this invention has been provided. However, the present invention is not limited to the disclosed embodiment only but also covers various changes and modifications thereof.

In the board-mounted connector according to the present invention, the space between a board and a ground plate is increased due to the fact that the ground plate is bent so that it intersects with the electrical contacts, and the bent section has openings to accommodate sections of signal contacts, thereby providing for the effect that the area occupied by a back portion of the connector is reduced along with an actual height of the connector, thus making it possible to reduce the area on the board occupied by the connector.

I claim:

1. A board-mounted connector for mounting onto a circuit board and for electrical connection to an electrical connector thereon, comprising a housing having contact-receiving cavities;

electrical contacts disposed in the contact-receiving cavities and including right-angle termination sections electrically connected to a junction board; and a ground plate mounted on the housing and having a slanted extension extending in the same direction as the right-angle termination sections of the electrical contacts and having termination members electrically connected to the junction board, the right-angle termination sections are extendable through openings in the slanted extension thereby permitting the electrical connector to be located between the circuit board and the slanted extension so that an end of the junction board is electrically connected to the electrical connector when the board-mounted connector is mounted onto the circuit board.

2. A board-mounted connector as claimed in claim 1, wherein the ground plate has a base section mounted in a groove in the housing.

3. A board-mounted connector as claimed in claim 2, wherein tabs extend from the base section for electrical engagement with lugs on a card inserted in a card-receiving slot of the board-mounted connector.

4. A board-mounted connector as claimed in claim 3, wherein barbs are provided on opposing surfaces of adjacent tabs for securing the ground plate in the groove.

5. A board-mounted connector as claimed in claim 1, wherein the right-angle termination sections are crank-shaped.

6. A board-mounted connector as claimed in claim 1, wherein latches are provided at ends of the ground plate, the latches having spring-loaded tongues engaging shoulders of the housing.

7. An electrical connector for mounting onto a circuit board and for electrical connection to a junction connector on the circuit board, comprising a dielectric housing having contact-receiving cavities extending therethrough;

electrical contacts disposed in the contact-receiving cavities and including crank-shaped termination sections electrically connected to a junction board;

a ground plate mounted on the dielectric housing and having a slanted extension provided with openings, and termination members electrically connected to the junction board, the slanted extension extending along the crank-shaped termination sections so that right-angle sections of the crank-shaped termination sections are extendable within the openings in the slanted extension thereby permitting the junction connector to be located between the circuit board and the slanted extension so that an end of the junction board is electrically connected to the junction connector when the electrical connector is mounted onto the circuit board.

8. An electrical connector as claimed in claim 7, wherein the ground plate includes tabs extending into a card-receiving slot in the dielectric housing.

* * * * *